US005133530A

United States Patent [19]

Thoresen

[11] Patent Number: 5,133,530

[45] Date of Patent: Jul. 28, 1992

[54] ADJUSTABLE MOLD FOR CASTING A CONCRETE STAIRWAY

[76] Inventor: Bjørn O. Thoresen, Toppveien 15, 3500 Honefoss, Norway

[21] Appl. No.: 678,960

[22] PCT Filed: Oct. 18, 1989

[86] PCT No.: PCT/NO89/00108

§ 371 Date: May 17, 1991

§ 102(e) Date: May 17, 1991

[87] PCT Pub. No.: WO90/04693

PCT Pub. Date: May 3, 1990

[30] Foreign Application Priority Data

Oct. 19, 1988 [NO] Norway ..... 884650

[51] Int. Cl.[5] ..... E04G 13/06; B28B 7/22

[52] U.S. Cl. ..... 249/14; 249/8; 249/208

[58] Field of Search ..... 249/14, 208, 8; 52/182

[56] References Cited

FOREIGN PATENT DOCUMENTS 1934586 7/1969 Fed. Rep. of Germany ..... 249/14
1954594 5/1971 Fed. Rep. of Germany ..... 249/14
2155577 5/1973 Fed. Rep. of Germany .
2243250 3/1974 Fed. Rep. of Germany .
2407871 8/1975 Fed. Rep. of Germany .
3518200 8/1986 Fed. Rep. of Germany .

*Primary Examiner*—Jay H. Woo
*Assistant Examiner*—Khanh P. Nguyen
*Attorney, Agent, or Firm*—Wenderoth, Lind & Ponack

[57] ABSTRACT

An adjustable mold for casting stairways of concrete enables the total length of a stairway and also the dimension of the separate steps to be adjusted. The mold includes a longitudinal horizontal frame supporting two identical parallel articulated arm systems positioned scissor-like and being linked together at intersection points of arms of the system along a longitudinal center axis thereof. At oppositely located and linked outer ends of the arms are provided pivotable supports for a number of step units, each of which includes an upstep and an instep. An inner edge of each instep substantially by its own weight rest against the upstep of an adjacent step unit. The total length of the articulated arm link system may be adjusted, thereby simultaneously adjusting the distance between adjacent step units. Also, the angular position of the step units relative to the support frame can be adjusted.

19 Claims, 3 Drawing Sheets

ADJUSTABLE MOLD FOR CASTING A CONCRETE STAIRWAY

BACKGROUND OF THE INVENTION

The present invention relates to casting equipment for production of stairways or staircases of concrete, and more particularly to an adjustable casting mold for production of stairways having various lengths, climbing heights, and number of dimensions of separate steps of the stairway.

In order to meet specifications for stairways for different individual building constructions, the building industry substantially has been required to have available a large number of different casting molds, a situation which obviously is rather cumbersome and expensive, among other things due to storage space requirements. Frequently it occurs that available casting molds do not have the specifications required for a particular construction, such that special casting molds still must be made, either in a factory or at the building site.

There are a number of known proposals for adjustable casting molds for casting stairways of concrete, but such known designs hitherto have not been very successful, partly because the constructions have been rather complicated and cumbersome both in construction and use, especially because the possibilities for adjustment have not proved to be sufficient. Illustrative prior art systems are disclosed in German Patent No. 35 18 200, German published Patent Application No. 21 55 577 and No. 24 07 871, French Patent No. 2 332 685 and Swedish Patent No. 425 572.

SUMMARY OF THE INVENTION

The casting mold in accordance with the present invention provides, in spite of a relatively simple construction, possibility for a very large number of adjustments, such that it is possible to produce stairways and staircases which meet substantially about any and all different specification requirements. With a pair of manual adjustments it is possible, in a stepless manner, to adjust the length, climbing height, number of steps and dimensions of upsteps and insteps of the stairway.

The casting mold in accordance with the invention is generally characterized by the following features:

a longitudinal, horizontally extending supporting frame includes parallel, longitudinal supporting elements, two mutually identical, articulated link arm systems displaceably arranged on the supporting frame and are pivotally linked together in a scissors-like manner at points of overlapping intersection of arms of the systems crossing a longitudinal center line of the systems, opposing outer points of articulation of the arms support a plurality of step units in such fashion that the step units can undergo vertical pivotal movement, each step unit includes an instep and an upstep interconnected to form a right angle, there is provided means for adjusting the total length of the articulated link arm systems, thereby simultaneously adjusting the distance between adjacent step units, and means for adjustment of the angular position of the step units relative to the supporting frame.

With a casting mold in accordance with the invention it is possible by means of two simple separate adjustments to accomplish a stepless adjustment of the length of the stairway and the position of each step unit. By such adjustments it also is possible to define the number of steps required in the stairway to be built, the climbing height of the stairway as a whole and the climbing height of each upstep of the stairway.

Through simple adjustments it also is possible to adjust the depth of the insteps of the stairway.

BRIEF DESCRIPTION OF THE DRAWINGS

The invention shall be further described with reference to the accompanying drawings which in detail illustrate an embodiment for a casting mold in accordance with the invention, and wherein.

DETAILED DESCRIPTION OF THE INVENTION

Figure 1:
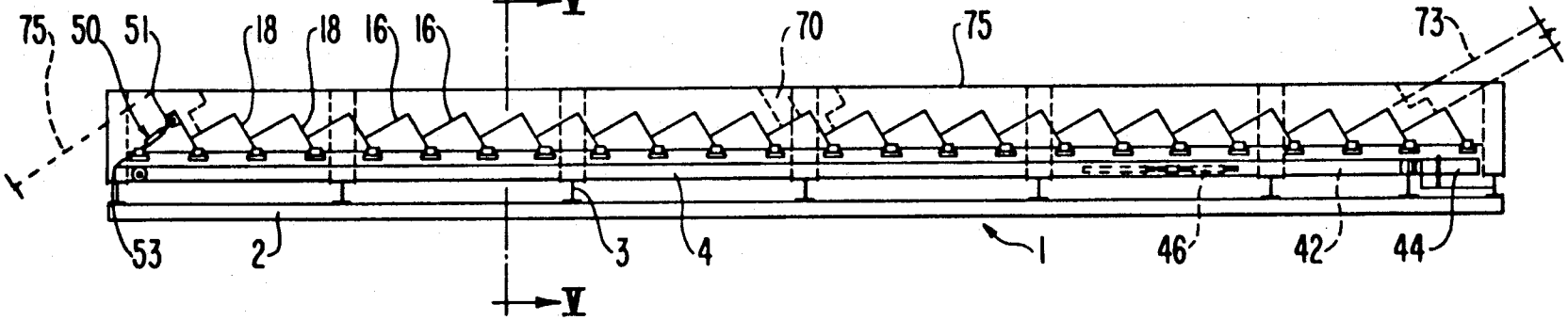
FIGS. 1 and 2 are a lateral view and a plan view, respectively, of a casting mold in accordance with the invention.
Figure 2:
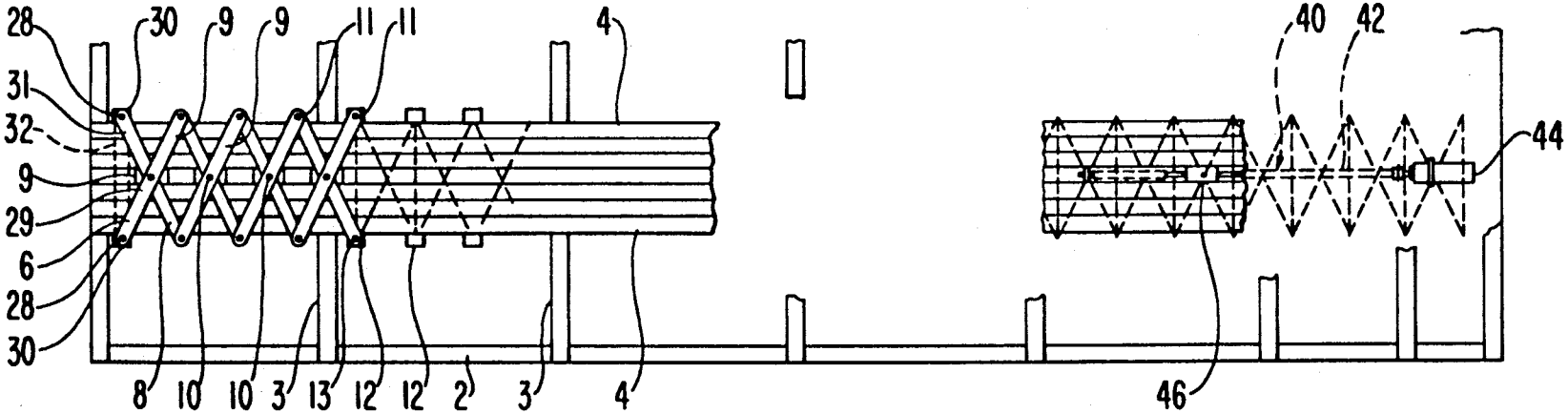
Figure 3:
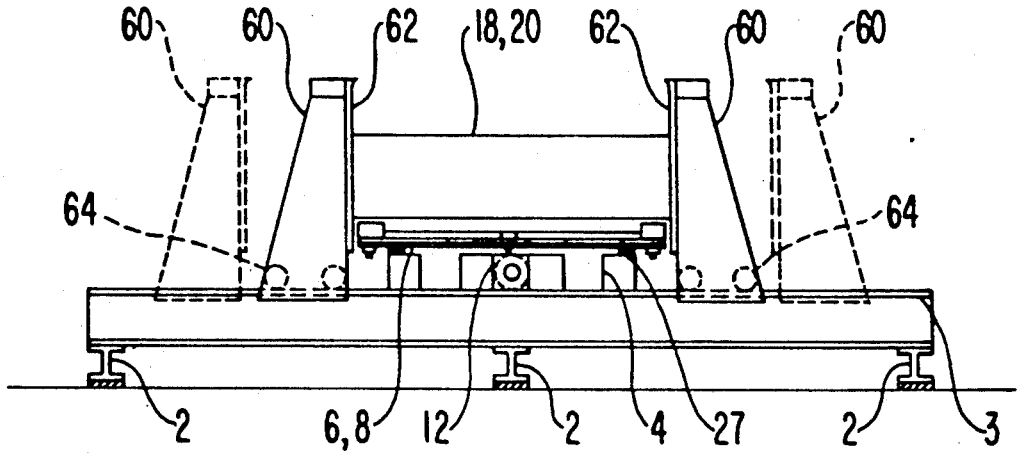
FIG. 3 is an end view seen from the left side of the mold as shown in FIG. 1 and on a somewhat enlarged scale.

As shown in FIGS. 1, 2 and 3, a casting mold comprises a support frame 1 including three longitudinal support beams provided with superimposed transverse beams. On top of beams 3 are positioned four longitudinal channel-shaped beams 4 which form support for two identical arm link systems 6 and 8 which are arranged in a symmetrical scissors-like formation and are interlinked at intersection areas or midlength portions 9 thereof along the center line of the structure by means of center pivot bolts 10. The bolts 10 are further supported on saddle-like channel brackets 17 which are displaceably mounted between the two central channel beams 4. The separate arms in the two arm link systems 6 and 8 are further linked together at opposite lateral ends thereof by means of end pivot bolts 11, 13. As best shown in the plan view of FIG. 2, the link points between each pair of arms of one system are positioned directly opposite to link points between each pair of arms of the other system, relative to the longitudinal center axis of the structure. Each of the pivot bolts 11, 13 forms a support for a support sabot 14, the design of which best appears from the detail view shown in FIG. 4.

Figure 4:
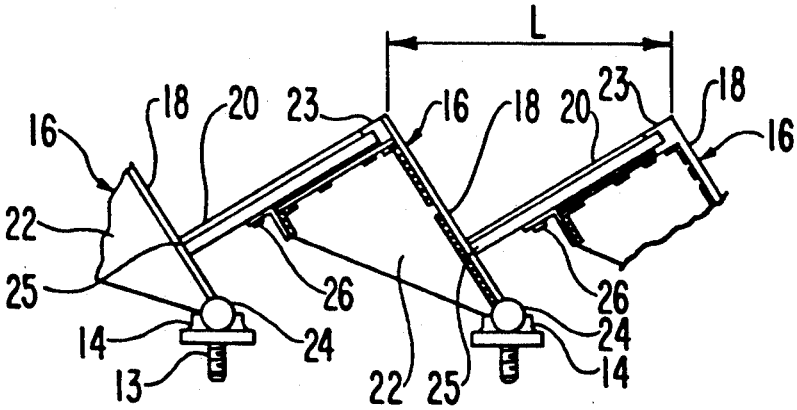
FIG. 4 is a detailed lateral view on a further enlarged scale and which illustrates the construction of steps or step units and the function thereof.
Figure 6:
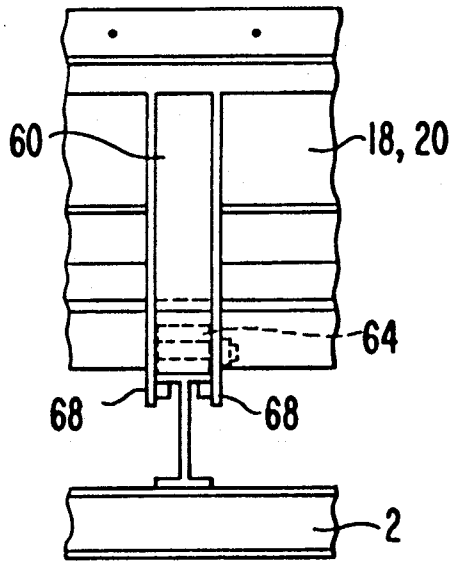
FIG. 6 is a fragmentary side view along plane VI—VI in FIG. 5.

As best appears from FIGS. 1 and 4, the course of the stairway is built up by means of step units 16 each of which comprises an "upstep" 18 and an "instep" 20. The upstep 18 includes two or more support brackets 22 each of which defines a right angle and is welded, at a lower edge of the upstep, to a transverse rod or shaft 24 which is pivotably arranged in the transverse direction of the structure and is displaceably supported by respective of the sabots 14. The brackets 22 form support for the insteps 20. The insteps 20 preferably are releasably attached to the brackets 22 by means of screws 26 or the like, enabling an operator to install insteps having various depths. In the illustrated embodiments, at a corner zone of bracket 22 between the upstep and instep is provided a list 23 which constitutes a section of the instep and is adapted for receipt of the instep via a tongue and grove arrangement or the like. As shown in FIGS. 1 and 4, longitudinal edges 25 of the insteps rest with their weight loosely against the respective adjacent upsteps 18.

The two link arm systems are, via the undermost positioned arms, looseably and slideably biased against the outer channel beams 4. On top of these channel beams 4 may, if desired, be positioned longitudinal slide strips 27 as shown in FIG. 3.

At the left end of the two arm link systems 6 and 8 the last or endmost pair of arms 29, 31 are pivotally supported on pivot bolts 28 which further are supported on collar-like brackets 30 which are laterally displaceably supported on a transverse element 32 attached on the top side of the support frame. Thereby, the ends of the scissor arms or pairs of arms on either side of the central line thereof may move inwardly and outwardly relative thereto during the extension and contraction, respectively, of the arm system.

The casting mold provides two possibilities for stepless adjustment, namely a first stepless adjustment of the length of the stairway and thereby the distance between each separate step by means of the scissors arm system, and a second adjustment of the dimensions of the separate steps.

The length of the scissors arm system of the illustrated embodiment is adjusted by means of a worm screw 42 which at the right end thereof as shown in FIG. 2 can be connected to an electrical motor 44 via a reduction gear or the like. On the worm screw is positioned a threaded bushing 46 which is attached to one of the brackets 12 which form support for one of the pivot bolts 10 of the scissors arm system. It will be understood that when such one bracket 12 and the respective pivot bolt 10 thereof is displaced forwardly or backwardly, such will cause the entire scissors arm system to be extended or shortened, respectively.

The angular position of the step units is adjusted by means of a longitudinally adjustable element such as a worm screw 50 or the like which is supported at one end thereof at a pivot point 51 on the last or endmost step 52 to the left as shown in FIG. 1 and at another end thereof at a pivot point 53 on the support frame 2. When, for example, the element 50 is extended, the last step 52 will be forced upwardly. This will cause all of the step units simultaneously to be pivoted upwardly in a corresponding manner since the end edge 25 of each instep will slide or be displaced upwardly along the adjacent upstep, such that the actual height of the upstep will be correspondingly reduced.

Figure 5:
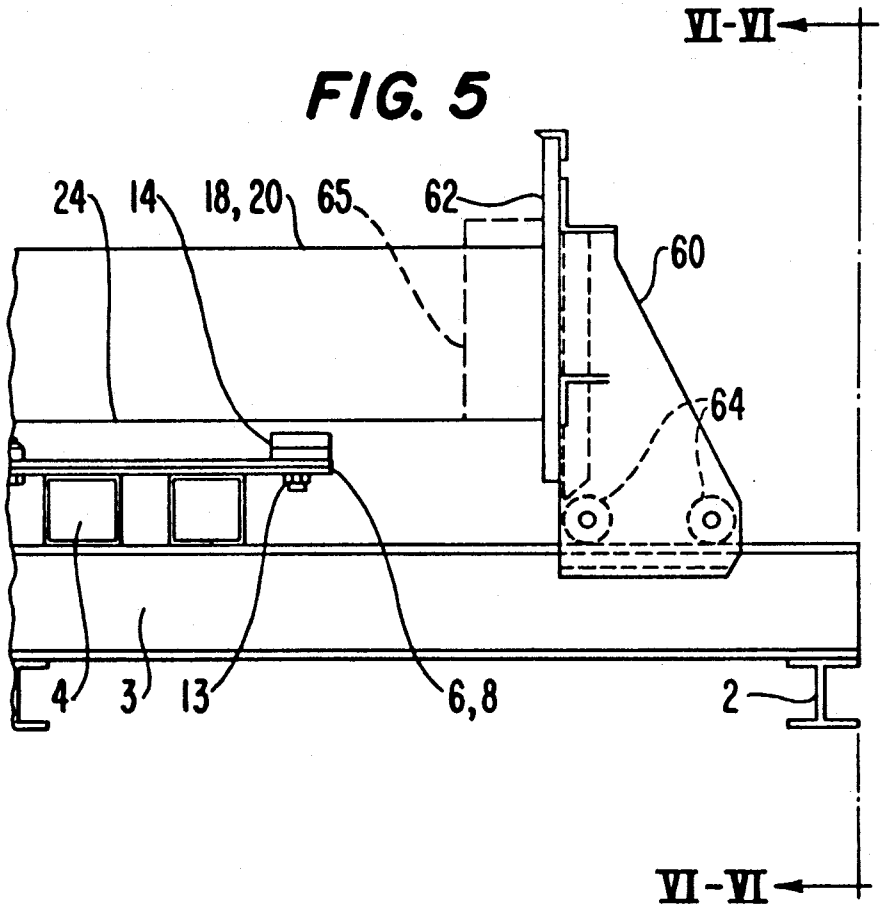
FIG. 5 is a fragmentary sectional view along plane V—V in FIG. 1 which illustrates on an enlarged scale, a right half part of the mold and which especially illustrates a side part of the mold and the adjustment of the width of the casting mold and a stairway made thereby.

The width of the casting mold and thereby the width of the stairway molded therein can be adjusted in several different ways. In the illustrated solution, the mold surfaces for the lateral sides of the stairway are provided by means of adjustable posts 60 which are best shown in FIG. 5 and which on the inside thereof are provided with mold plates or wall members 62. The posts 60 with corresponding structure thereof are laterally displaceable, preferably by means of rollers 64 which are biased against the lateral beams 3 of the support frame. The posts 60 include lateral plates 68 which are biased against respective external sides of the lateral beams 3 and which thereby hold and guide the posts. The posts may be locked in position by means of bolts or the like, not shown. For determination of the width of the stairway one can arrange either one step unit for each width with upsteps and insteps or, in a preferred embodiment, one utilizes lining boxes which are positioned on the steps against the mold plates 62, as indicated in FIG. 5 by dashed lines 65.

The illustrated casting mold in accordance with the invention will operate and be used in the following fashion. In the making of an actual stairway the specifications of the stairway usually will be given, for instance the vertical height between two floors in question, the horizontal projection of the stairway, and possibly also the desired number of steps in the stairway based on the total height. A normal height of the upsteps is 15 to 18 cm. On this basis the required necessary length of the stairway is determined, and further determined is the suitable number of steps of the stairway if such value is not provided in the specifications. The illustrated casting mold includes altogether up to 23 possible step units. A straight stairway with more than 23 steps seldom is case. If the stairway is to be produced with, for instance, fourteen steps, the length of the casting mold is defined by means of the worm screw arrangement 40 until the desired length has been set. Thereafter, the angular position of the step units is adjusted by means of the adjustment element 50 by which the elevation or height of the steps is calibrated or set. In some cases it will be determined, during adjustment of the casting mold, that the number of steps of the stairway shown be increased or possibly reduced by one step. Such readjustment can simply be carried out by extending or shortening, respectively, the distance L between adjacent steps and by a suitable readjustment of the height of the upsteps by means of a corresponding adjustment of the angular position between each of the step units. Thereafter the casting mold is closed off at opposite ends by means of standardized termination units 70, 73, 75 (shown by dashed lines in FIG. 1), in order to cast landings at the top and at the bottom of the stairway.

When the various adjustments of the casting mold have been finalized, the mold is filled with concrete up to the top edge of the mold and further the separate mold units at each end are filled in order to form the desired landings at the top and at the bottom of the stairway. The top surface of the mold (the under side of the stairway) is thereafter stripped off by means of a stripping member, whereafter the molded surface, if desired, is dressed or polished.

The depth of the insteps may be adjusted by means of the casting mold in accordance with the invention. Insteps normally are specified to be of various depths, namely 250, 272, 300 and 325 mm. To form stairways with the beforementioned different depths there may be provided sets or insteps of such depths. The desired set of insteps is mounted on the support brackets 22 as shown best in FIG. 4. When mounting, for instance, deeper insteps one must normally readjust the distance L between each step unit, i.e. extend this dimension, in order to maintain a correct angle between the insteps and upsteps.

It will be understood that, by means of the casting mold in accordance with the invention, it is possible to carry out a substantially stepless adjustment of the different specifications of the stairway including the length of the stairway, the dimension between adjacent steps, and the height of the upsteps. Further, by employing insteps of different depths, it also is possible to form stairways with varying instep depths. Also, the lateral dimension of the stairways may be adjusted in a very simple fashion.

I claim:

1. An adjustable mold for casting concrete stairways of selected different dimensions, said mold comprising:

a longitudinal, substantially horizontal supporting frame;

a pair of identical link arm systems defined by respective pluralities of link arms of equal length and supported on said supporting frame for displacement longitudinally thereof;

each said link arm of each said link arm system being linked at a mid-length position thereof by a respective center pivot to a respective said link arm of the other said link arm system, such that said link arms of said pair of link arm systems are coupled successively in pairs of arms with the respective said center pivot of each said pair of arms being positioned along a longitudinal center line of said pair of link arm systems;

said arms of said pairs of arms having opposite ends linked by respective end pivots to respective ends of arms of successive adjacent pairs of arms, such that said end pivots are located in pairs on opposite sides of said longitudinal center line with said end pivots of each pair of end pivots being positioned along a line extending transverse to said longitudinal center line;

a plurality of step units, each said step unit including an instep and an upstep, each said instep having a transverse edge resting against an upstep of an adjacent step unit;

means, mounted on said end pivots of each said pair of end pivots, for supporting each respective said step unit for vertical pivotal movement about a respective axis extending along a lower end of the respective said upstep;

means for moving at least one of said center pivots longitudinally of said supporting frame, thereby effecting simultaneous extension or retraction of said pair of link arm systems, and thus adjusting the spacing between steps to be formed by adjacent said step units; and means for adjusting the relative angular position of said step units about said axes thereof.

2. A mold as claimed in claim 1, wherein outer portions of said link arms are supported displaceably by outer longitudinal portions of said supporting frame on respective opposite sides of said longitudinal center line.

3. A mold as claimed in claim 1, wherein said supporting frame includes means for guiding movement of said center pivots along said longitudinal center line.

4. A mold as claimed in claim 3, wherein said guiding means comprises longitudinal center guides spaced on opposite sides of said longitudinal center line.

5. A mold as claimed in claim 4, further comprising brackets supporting respective said center pivots and positioned for longitudinal movement between said center guides while being guided thereby.

6. A mold as claimed in claim 5, wherein said moving means comprises a worm screw mounted on said supporting frame and threadingly engaging one of said brackets.

7. A mold as claimed in claim 1, wherein said moving means comprises a worm screw mounted on said supporting frame and operably connected to said at least one center pivot to cause, upon rotation of said worm screw, movement of said at least one center pivot longitudinally of said supporting frame.

8. A mold as claimed in claim 1, wherein said supporting means comprises, for each said step unit, a transverse shaft having opposite ends supported by the respective said pair of end pivots and defining said axis.

9. A mold as claimed in claim 8, wherein each said upstep includes at least one bracket connected to the respective said shaft for mounting of the respective said instep.

10. A mold as claimed in claim 9, wherein said bracket defines a right angle between said upstep and said instep.

11. A mold as claimed in claim 1, wherein said insteps are formed of plural parallel parts that are selectively removable to thereby adjust the depth of said insteps.

12. A mold as claimed in claim 1, comprising plural sets of said step units having different lateral dimensions and selectively removably mountable in said mold, thereby to cast stairways of correspondingly different lateral dimensions.

13. A mold as claimed in claim 1, further comprising wall members mounted relative to said supporting frame to define lateral sides of the stairway to be cast.

14. A mold as claimed in claim 13, wherein said wall members are adjustably mounted on said supporting frame.

15. A mold as claimed in claim 13, wherein said wall members are selectively replaceably mounted on said supporting frame.

16. A mold as claimed in claim 13, further comprising lining boxes selectively removably mounted at opposite sides of said step units and confronting said walls members, thereby to enable the lateral dimension of the cast stairway to be adjusted.

17. A mold as claimed in claim 1, further comprising supplemental mold members for defining end or landing portions of the cast stairway.

18. A mold as claimed in claim 1, wherein said adjusting means comprises an adjustable element operatively mounted between said supporting frame and one of said step units.

19. A mold as claimed in claim 18, wherein said adjustable element comprises a worm screw.

* * * * *